US006179566B1

(12) United States Patent
Andulics et al.

(10) Patent No.: US 6,179,566 B1
(45) **Date of Patent: *Jan. 30, 2001**

(54) BLOWER WHEEL ASSEMBLY WITH STEEL HUB, AND METHOD OF MAKING SAME

(75) Inventors: Joseph H. Andulics, North Ridgeville; Gregory R. Nagy, Elyria, both of OH (US)

(73) Assignee: Beckett Air Incorporated, North Ridgeville, OH (US)

( * ) Notice: Under 35 U.S.C. 154(b), the term of this patent shall be extended for 0 days.

This patent is subject to a terminal disclaimer.

(21) Appl. No.: 09/316,658

(22) Filed: May 21, 1999

Related U.S. Application Data

(63) Continuation-in-part of application No. 08/954,937, filed on Oct. 21, 1997.

(51) Int. Cl.[7] ..... B63H 1/26
(52) U.S. Cl. ..... 416/178; 416/204 R
(58) Field of Search ..... 416/1, 178, 204 R, 416/214 R, 214 A, 206

(56) References Cited

U.S. PATENT DOCUMENTS

| | | | |
|---|---|---|---|
| 1,069,854 | 8/1913 | Chisholm et al. . | |
| 1,410,093 | 3/1922 | Dallmeyer et al. . | |
| 1,657,758 | 1/1928 | Lum . | |
| 2,125,697 | 8/1938 | Swingle et al. . | |
| 2,242,586 | 5/1941 | Marbach . | |
| 2,291,480 | 7/1942 | Marbach . | |
| 2,473,185 | 6/1949 | Weiss . | |
| 2,496,179 | 1/1950 | Schwarz . | |
| 2,628,419 | 2/1953 | Wilken . | |
| 2,684,521 | 7/1954 | Morrison, Jr. . | |
| 2,724,547 | 11/1955 | Abbott et al. . | |
| 3,156,408 | 11/1964 | Whitenack, Jr. . | |
| 3,165,258 | 1/1965 | Wentling . | |
| 3,221,398 | 12/1965 | Mayne . | |
| 3,253,318 | 5/1966 | Wentling et al. . | |
| 3,262,637 | 7/1966 | Sprouse et al. . | |
| 3,355,930 | 12/1967 | Fedorov . | |
| 3,385,511 | 5/1968 | Wentling et al. . | |
| 3,567,335 | 3/1971 | David et al. . | |
| 3,608,174 | 9/1971 | Baker . | |
| 3,711,914 | 1/1973 | Baker . | |
| 3,750,442 | 8/1973 | Cogan . | |
| 3,816,023 | 6/1974 | Shaver . | |
| 3,844,682 | 10/1974 | Morris . | |
| 3,854,844 | 12/1974 | Ranz . | |
| 4,015,461 | 4/1977 | Schober . | |
| 4,245,491 | 1/1981 | Kondo et al. . | |
| 4,254,540 | 3/1981 | Bilak . | |
| 4,315,357 | 2/1982 | Calvano . | |
| 4,329,118 | 5/1982 | Ranz . | |
| 4,580,431 | 4/1986 | Oku et al. . | |
| 5,174,025 | 12/1992 | Tasaki et al. . | |
| 5,934,876 * | 8/1999 | Nagy | 416/178 |

* cited by examiner

*Primary Examiner*—Edward K. Look
*Assistant Examiner*—Hermes Rodriguez
(74) *Attorney, Agent, or Firm*—Amin, Eschweiler & Turocy, LLP

(57) ABSTRACT

The invention includes a blower wheel assembly and method characterized by a steel hub with protruding lugs that mate with a corresponding array of holes in a backplate of the assembly. The lugs are riveted or otherwise deformed to upset the lug material, thereby permanently and securely attaching the hub to the backplate. The lugs may be formed on the hub by a machining process. The holes in the backplate may have stress relief portions to avoid stress concentrations in corners of the holes.

19 Claims, 7 Drawing Sheets

BLOWER WHEEL ASSEMBLY WITH STEEL HUB, AND METHOD OF MAKING SAME

This is a continuation-in-part of application Ser. No. 08/954,937, filed Oct. 21, 1997.

TECHNICAL FIELD

The present invention includes to a blower wheel assembly and methods of manufacturing the same. In particular, the invention includes a blower wheel assembly with a steel hub having protrusions to securely attach the hub to a backplate of the blower wheel assembly.

BACKGROUND OF THE INVENTION

FIG. 1 shows a prior art centrifugal blower wheel assembly 10 which includes a backplate 12, a hub 14, and a plurality of blades 16. The hub 14 and the blades 16 are attached to the backplate 12, which is typically a separate part. The blades 16 are secured to a ring 17; alternatively, the blades may be formed as a single piece, known as a bladestrip. The assembly 10 is used by attaching it to a rotational mechanism (not shown) via the hub 14 by means of a shaft (not shown). Rotation of the shaft causes rotation of the hub 14, backplate 12 and blades 16, thereby providing air flow. The connection between the backplate 12 and the hub 14 therefore is required to transmit the rotational torque of the shaft.

The maximum torque the hub 14 can withstand before coming loose with respect to the backplate 12 is termed the holding torque. The holding torque is a function of the way in which the hub is attached to the backplate. In addition, the holding torque can decrease over time as use changes the strength of that attachment. If the holding torque is exceeded, the hub becomes loose and will spin independently of the backplate 12, resulting in a catastrophic failure of the blower wheel assembly.

FIGS. 2A–2C illustrate details of a prior art hub and backplate configuration. The hub 14 has a concentric rim or lip 18 protruding from a front surface 19 of the hub 14. The lip 18 is designed to be placed in a hole 20 of the backplate 12 as illustrated in FIG. 2C. The hub 14 has a back surface 22 through which a hole 24 extends in order to receive a shaft (not shown) or other member for rotation. A threaded set screw hole 26 is provided along a radius of the hub. A set screw (not shown) can be threaded in the hole 26 to allow for the assembly 10 to be fixed with respect to the shaft within the hole 24.

The hub 14 is attached to the backplate 12 by forcing back (via stamping, for example) the rim or lip 18 while the rim or lip 18 extends through the hole 20 of the backplate 12, thereby crimping the rim or lip 18 against the backplate 12 and holding the hub 14 thereto. In some circumstances, however, the holding torque for this type of arrangement is either insufficient or inconsistent, and therefore undesirable.

The backplate 12, the hub 14, and the blades 16 are all typically made of steel, which provides for high strength, low cost, and ease of manufacture.

An objective of the invention is to provide a blower wheel assembly with a hub that is more strongly attached to the backplate, that can be used over a wide range of temperatures, and that is inexpensive to manufacture.

SUMMARY OF THE INVENTION

The invention includes a blower wheel assembly and method characterized by a steel hub with protruding lugs that mate with a corresponding array of holes in a backplate of the assembly. The lugs are riveted or otherwise deformed to upset the lug material, thereby permanently and securely attaching the hub to the backplate. The lugs may be formed on the hub by a machining process. The holes in the backplate may have stress relief portions to avoid stress concentrations in corners of the holes.

According to one aspect of the invention, a blower wheel assembly includes a backplate with an array of hub mounting holes therein; a plurality of blades attached to the backplate; and a steel hub attached to the backplate, the steel hub having one or more lugs corresponding to the array of holes, the lugs being formed by a machining process.

According to another aspect of the invention, a method of manufacturing a blower wheel assembly includes forming a steel hub having one or more machined lugs; and attaching the steel hub to a backplate which has an array of hub mounting holes corresponding to the one or more lugs, wherein the attaching includes inserting the lugs in the hub mounting holes and deforming the lugs to lock the hub in place.

According to yet another aspect of the invention, a blower wheel assembly includes a backplate with an array of hub mounting holes therein, each hub mounting hole having a stress relief portion; a plurality of blades attached to the backplate; and a hub attached to the backplate, the hub having one or more lugs corresponding to the array of holes.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

Figure 2A:
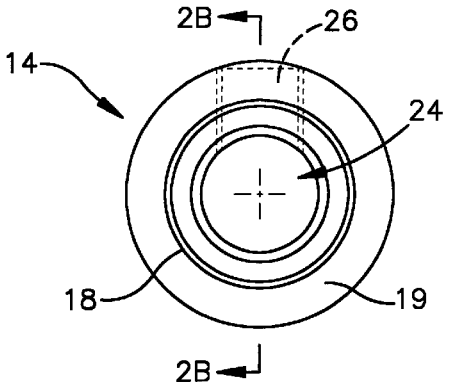
Fig.2A (PRIOR ART)
FIG. 2A is an end view of a prior art hub for a blower wheel assembly.
Figure 2C:
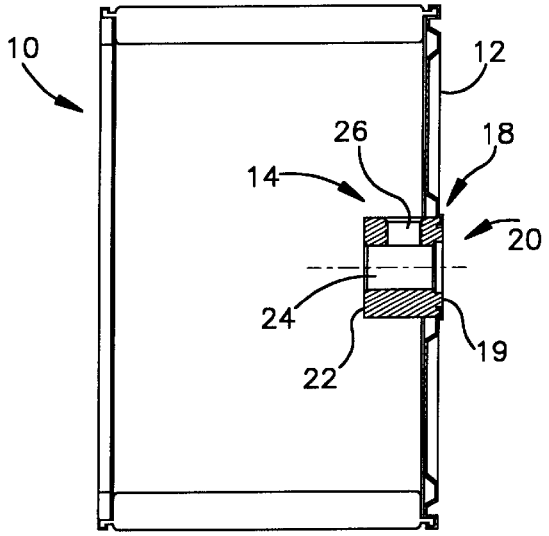
Fig.2C (PRIOR ART)
FIG. 2C is a sectional view showing the prior art hub attached to a backplate.
Figure 2B:
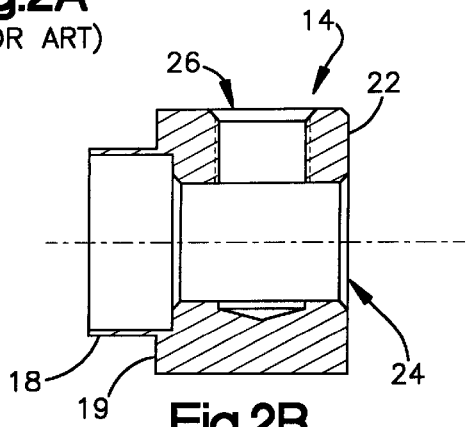
Fig.2B (PRIOR ART)
FIG. 2B is a sectional view along section A—A of FIG. 2A.
Figure 3A:
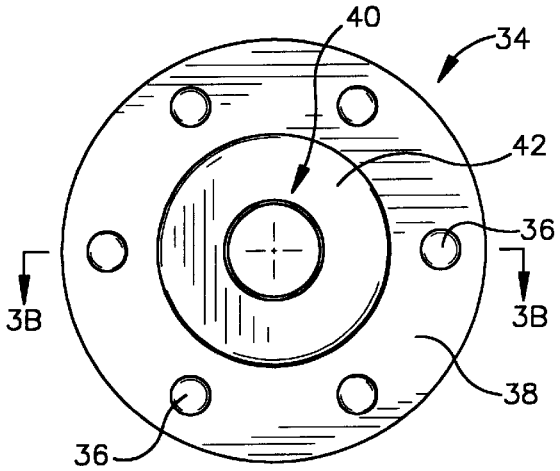
Fig.3A (PRIOR ART)
FIG. 3A is an end view of a prior art aluminum hub with protrusions.
Figure 3B:
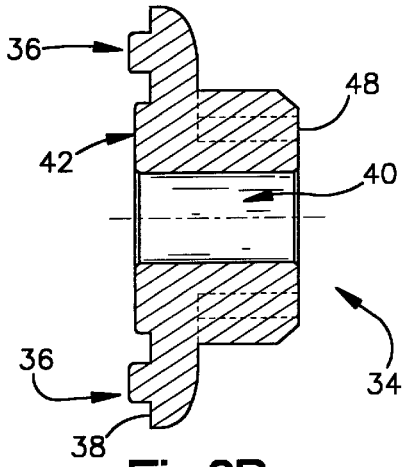
Fig.3B (PRIOR ART)
FIG. 3B is a sectional view of the prior art aluminum hub.
Figure 3C:
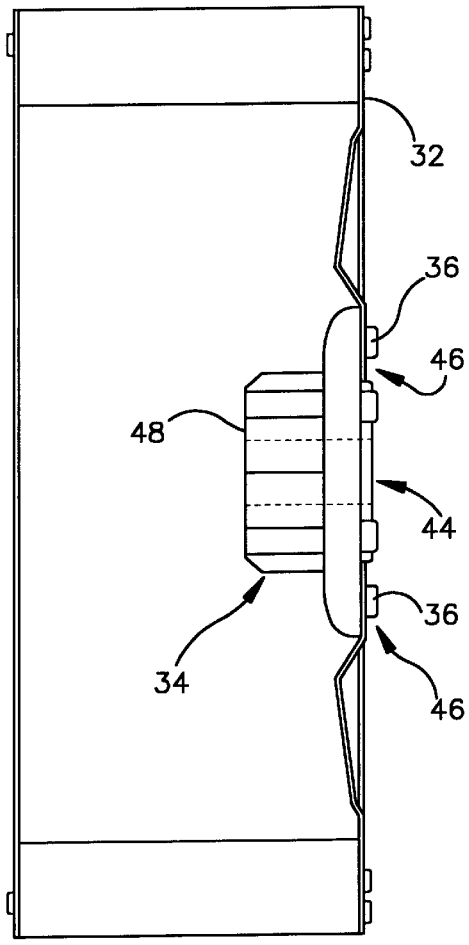
Fig.3C (PRIOR ART)
FIG. 3C is a side view of the prior art aluminum hub attached to a backplate.

FIGS. 3A–3C show a prior art aluminum hub 34 for accommodating a backplate 32. The prior art aluminum hub 34 has six radial protrusions 36 (also called lugs or pips) extending from a front surface 38 of the hub 34. The protrusions 36 are formed on the hub 34 by cold extrusion. A hole 40 extends through the hub 34 to receive a shaft for rotation (not shown), similar to the way in which the hole 24 extends through the hub 14 in the prior art blower wheel assembly of FIGS. 2A–2C. Besides the lugs 36 there is a central protrusion 42 extending from the front surface 38. The backplate 32 has a central hole 44 to receive the central protrusion 42 and an array of holes 46 for receiving the lugs 36. The hub 34 is attached to the backplate 32 by first engaging the lugs 36 and the central protrusion 42 of the hub 34 in the corresponding holes 44 and 46 of the backplate 32. Then, while a back surface 48 of the hub 34 is held in place, the lugs 36 are struck with sufficient force to cause them to deform, flattening them such that they no longer can be pulled back through the holes 46. This securely attaches the hub 34 to the backplate 32. The engagement of the lugs 36 in the array of holes 46 of the backplate 32 provides for increased strength in the attachment of the aluminum hub 34 to the backplate 32 for a blower wheel assembly using this prior art design.

However, difficulties have been discovered in evaluating the prior art aluminum hub 34. Use of an aluminum hub involves a joining of dissimilar metals, since the backplate 32 is made of steel. Steel and aluminum have different coefficients of thermal expansion, so the hub 34 and the backplate 32 endure stresses at the attachment points when the blower wheel assembly undergoes a change of temperature. This difference in coefficients of thermal expansion is particularly a problem when the blower wheel assembly is to be used in an environment subjected to wide swings of temperature, such as in a furnace or air conditioner. In such applications it is common for the blower wheel assembly to be subjected to changes from ambient temperature to 450° F. within one minute. Because the shaft which extends through the hole 40 is made of steel, thermal gradient cycling results in a long term reliability problem of the hub coming loose with respect to the shaft. Additionally, because the set screw is made of steel, thermal gradient cycling leads to loosening of the set screw, thereby causing the shaft to rotate independently of the hub and the rest of the blower wheel assembly.

Joining of the dissimilar metals aluminum and steel can also lead to galvanic corrosion in the hub.

Further, the relative malleability of aluminum when compared to steel results in difficulties in securing the shaft by use of the set screw mating with the threaded hole in the hub. Since the steel set screw is harder than the aluminum hub, the screw can strip the threads of the hole unless care is taken to avoid overtightening. The above-mentioned difficulties all but rule out use of blower wheel assemblies with aluminum hubs for applications with large thermal gradients. Consequently, the prior art aluminum hub 34 is undesirable in blower wheel assemblies.

Despite the difficulties inherent in the prior art aluminum hub 34, the malleability of aluminum has the advantage of being relatively easy to manufacture into a desired shape. In contrast, a steel hub with lugs is relatively difficult to manufacture. Several possible methods of manufacturing a steel hub with lugs, such as die casting or using a powdered metal process, turn out to have undesirable features.

Die-casting suffers from expensive tooling costs. In addition, the material that can be die cast is limited to zinc, aluminum, magnesium, and copper alloys. Die cast zinc is weaker than steel. Tooling wear is greater with die casting and piece price is higher than with steel, partly due to secondary operations such as sprue trimming and tumbling that would be necessary. Porosity may be an issue due to air entrapment in the mold cavity, resulting in a weaker part.

Powdered metal processes have the disadvantage that the metal produced is porous. This leads the lugs to have structural weaknesses at the preferred height/width ratio, making the lugs fragile and difficult to manufacture. These problems with manufacturability would result in a high rejection rate of hubs made by powdered metal processes. The problems can be alleviated to some extent by adding a second material (e.g., copper) to fill the gaps in the steel structure. However, this addition of a second material increases costs.

By contrast, it has been found that making lugs on a steel hub 54 by a cold-heading process (also known as cold upsetting or cold forging) provides cost and performance advantages over other methods of manufacture. Cold-heading does not require expensive tooling. In addition, the steel hub of an exemplary design may be manufactured in a cycle time of approximately two seconds by cold heading, as opposed to the approximately ten seconds required to machine a hub of similar dimensions. Further, the cold-headed process provides increased durability over the powdered metal processes (for substantial height/width ratios).

Figure 5A:
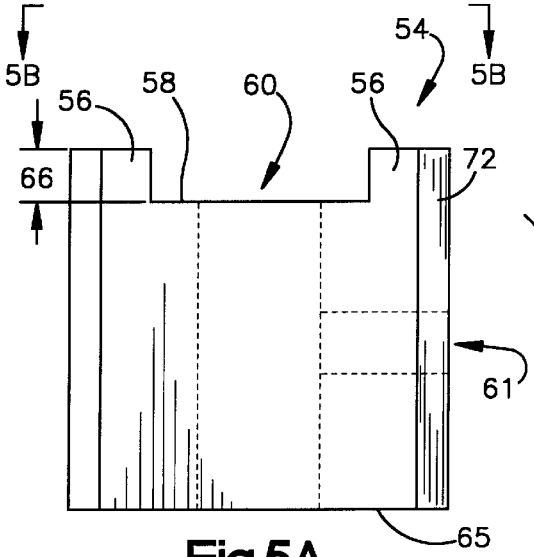
FIG. 5A is a side view of a hub of the present invention.
Figure 5B:
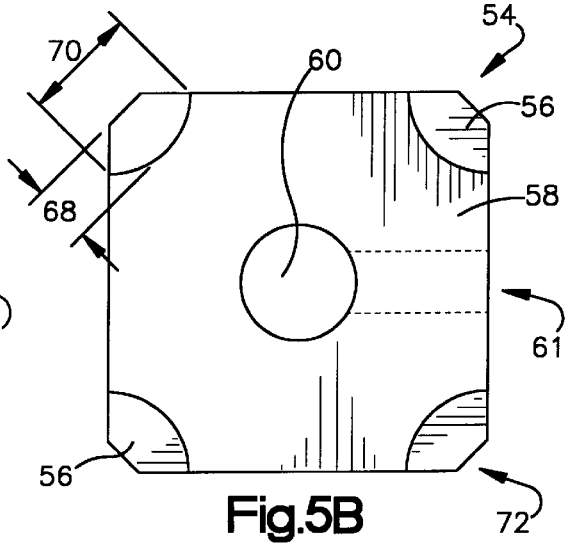
FIG. 5B is a plan view of the hub of FIG. 5A.
Figure 5C:
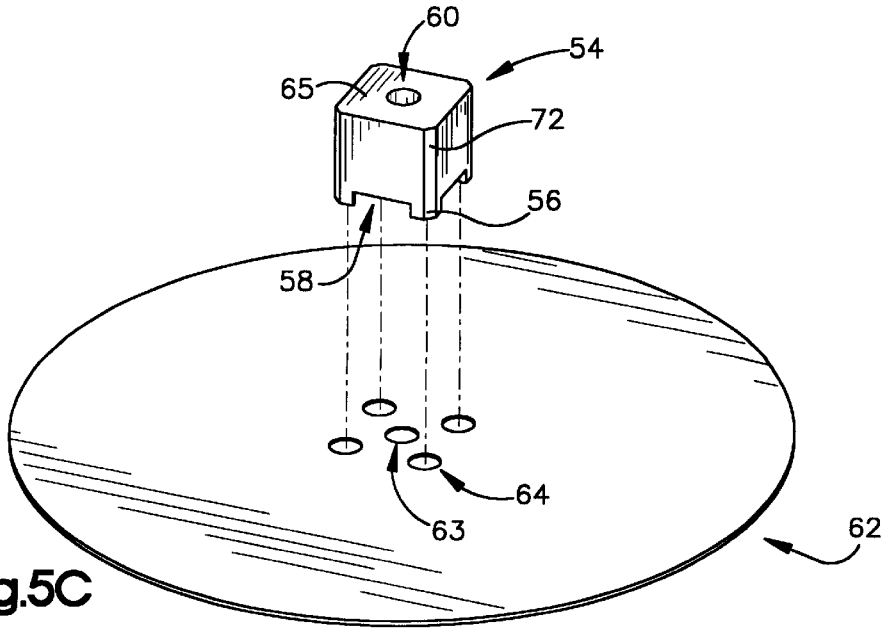
FIG. 5C is an exploded perspective view of a blower wheel assembly of the present invention.

The steel hub 54 in accordance with the present invention is shown in FIGS. 5A–5C. It has a plurality of lugs 56 extending from a front surface 58. In a manner similar to the prior art hubs, the hub 54 has a hole 60 extending therethrough to receive and engage a shaft (not shown). A threaded hole 61 is also provided for a set screw (not shown) that can fix the shaft to the blower assembly. The hub 54 is affixed to a backplate 62, as illustrated in FIG. 5C, which is similar in design to the backplate 32 in that the backplate 62 has a central hole 63 for accommodating the shaft and an array of holes 64 for mating with the lugs 56.

The assembly method for fixing the hub 54 to the backplate 62 involves first engaging the lugs 56 with the corresponding holes 64 of the backplate 62. Then, while a back surface 65 of the hub 54 is held in place, the lugs 56 are struck with sufficient force to cause them to deform such that they no longer fit through the holes 64 of the backplate 62. The process of striking the lugs 56 is termed "impacting", "riveting", or "upsetting", depending on the method of the striking.

Four lugs 56 are shown in the preferred embodiment illustrated in FIGS. 5A and 5B, although a greater or lesser number of lugs 56 may be used. A hub with four lugs 56, however, is preferred because of its relative symmetry and because it has been found to provide sufficient attachment strength for the blower wheel assembly. The use of fewer lugs than the prior art aluminum hub 34 provides the advantage of reduced cost of manufacture.

The lugs 56 may be formed into a variety of shapes. Cylindrical lugs, such as the lugs 36 employed in the prior art hub 34 (FIG. 2B) may be employed. Noncylindrical lugs, however, such as those shown in FIGS. 5A and 5B, have been found to be satisfactory. The lugs 56 have a height 66 which is approximately equal to their width 68 in the radial direction. The ratio of the width 68 to the height 66 may be in a broad range which is dependent on the characteristics of the material being worked. An exemplary range would be approximately 0.5:1 to approximately 2:1, with the ratio being prefereably greater than approximately 0.8:1. However, a ratio that is too small can result in lugs that are prone to breaking off, thereby making the hub 54 more difficult to manufacture. The lugs 56 have a length 70 in a radial direction that is preferably approximately twice the width 68 of the lugs. This increased thickness in the radial direction provides greater strength in the direction of hub rotation and thus results in increased strength against radial stresses between the hub 54 and the backplate 62. The lugs 56 having a shape such as that shown in FIGS. 5A and 5B will preferably be used with backplate holes 64 that are elliptical or slotted, but holes that are round or have other shapes may be used as well.

The hub 54 preferably has a basically square cross-section with flattened corners 72. It will be appreciated, however, that the hub 54 may have a round or other shaped cross-section. A hub of any shape having one or more cold-headed protrusions for engaging a backplate is contemplated as falling within the scope of the present invention.

Figure 6:
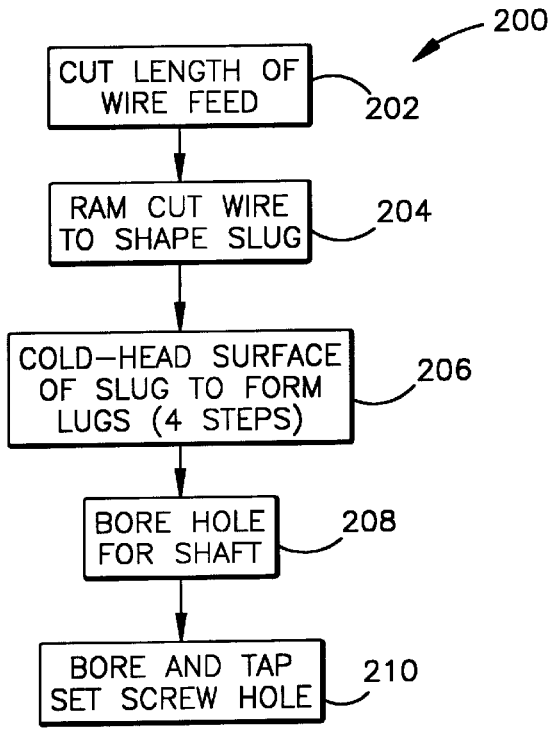
FIG. 6 is a flow chart showing the steps in the preferred method of manufacturing the hub of the present invention.

The method 200 of manufacturing of the steel hub 54 is illustrated in FIG. 6 and begins with cutting a length of steel wire at step 202 to a desired length. The hub 54 preferably is formed according to the disclosed method from lengths of 0.875" diameter steel wire, although the method is by no means limited as to the size or cross-sectional shape of the steel wire. The length of steel wire is then rammed (impacted with a shaping punch having a recess of a given shape) to form the wire into a slug having a desired cross-sectional shape, at step 204.

Figure 7:
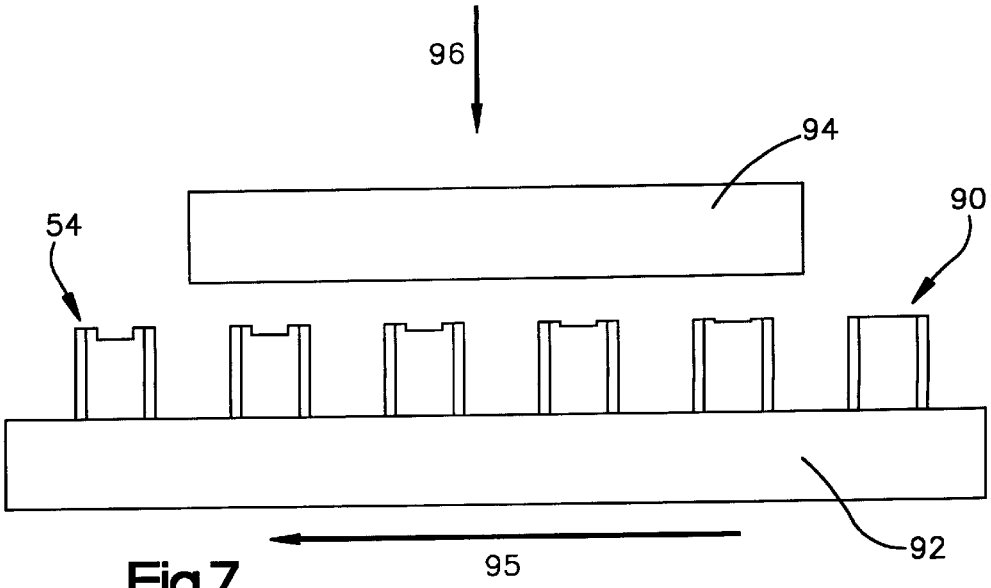
FIG. 7 is a side view showing a cold-heading process.

After ramming, the slug is then cold-headed to form the lugs 56 on the front surface 58, at step 206. This cold-heading process, illustrated in FIG. 7, consists of four substeps. A typical slug 90 is secured in a container or tray 92 which moves the slug 90 relative to a heading punch 94 in a direction 95. The front surface 58 of the slug 90 faces the punch 94. The punch 94 has an array of recesses (not shown) at four locations in the direction 95, the recesses at each of the locations corresponding to the shape of the slug 90 and the positions where the lugs 56 are to be formed. As the slug 90 reaches each of the locations in the direction 95, the container or tray 92 is stopped, and the punch 94 is engaged with great force in a direction 96 parallel to the axis of the slug 90. The resulting impact between the punch 94 and the slug 90 causes the steel of the slug 90 to be compressed with such force that the metal of the slug 90 flows into the recesses of the punch 94, thereby forming the lugs 56. The punch 94 is preferably designed to impact four slugs simultaneously, with four impacts on a single slug 90 needed to form the lugs 56 of the hub 54. However, the punch 94 may alternatively be designed to impact a greater or lesser number of slugs, with the impacting of multiple slugs not necessarily being simultaneous. In addition, cold-heading processes may be designed to be accomplished in greater than or less than four impacts.

After the cold-heading step 206, the method 200 of manufacturing the hub 54 includes boring the hole 60 for the shaft at step 208, and boring and tapping the set screw hole 61 at step 210.

Figure 8A:
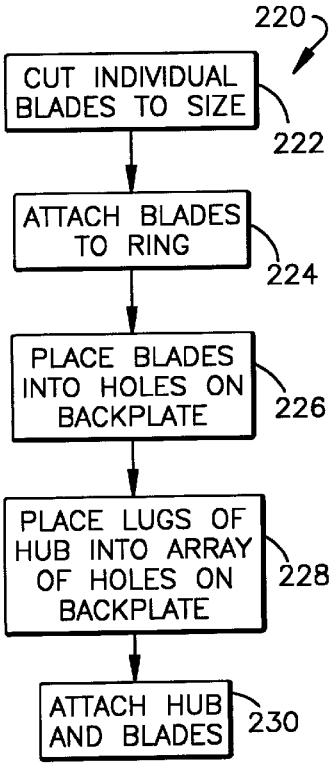
FIG. 8A is a flow chart showing the steps of a method of assembling a blower wheel assembly according to the present invention.
Figure 8B:
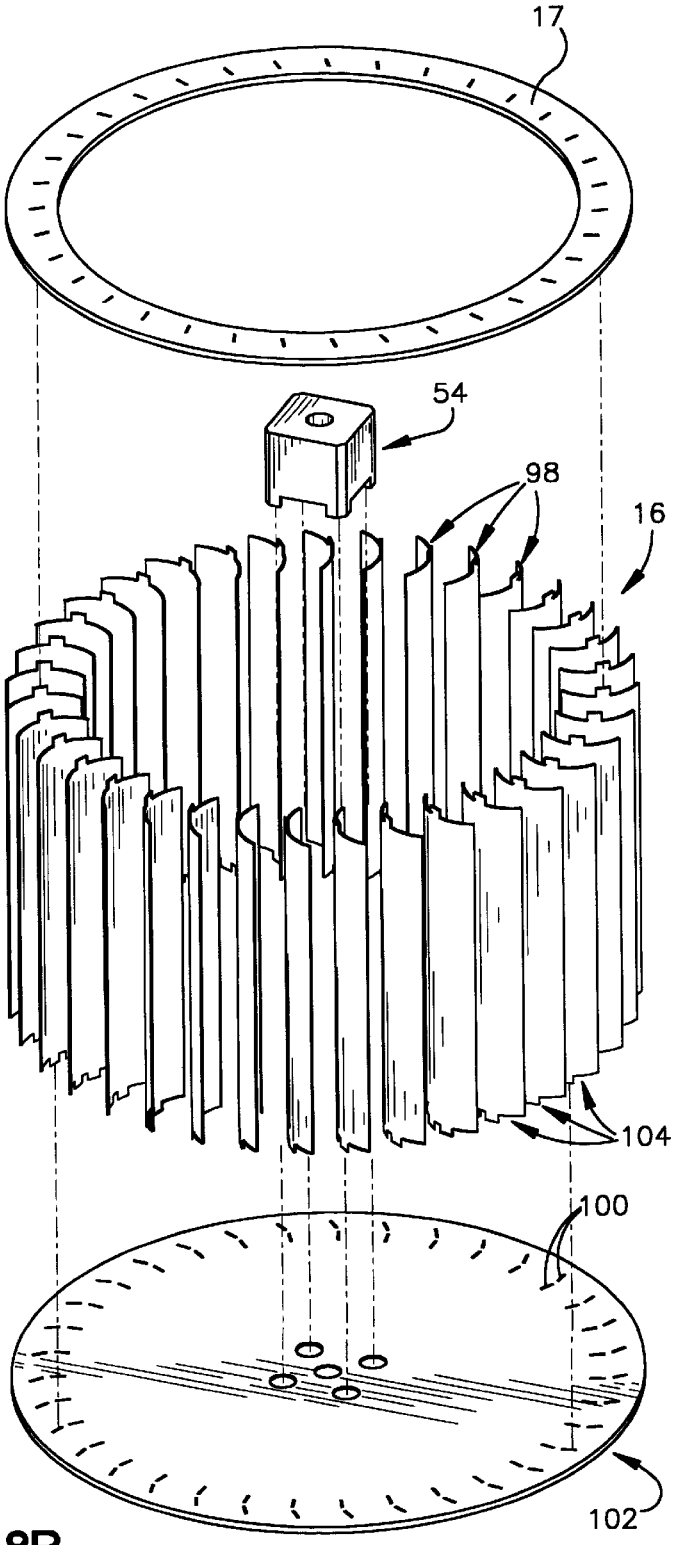
FIG. 8B is an exploded perspective view of the parts of the blower wheel assembly which are assembled by the method of FIG. 8A.

Turning to FIGS. 8A and 8B, a method 220 of manufacturing a blower wheel assembly of the present invention is shown. The initially individual blades 16 are cut to size at step 222. Then one end 98 of each of the blades 16 is attached to the ring 17 at step 224. The other ends 104 of the blades 16 are placed in holes or slots 100 in a backplate 102 at step 226. After the lugs 56 of the hub 54 are inserted in the array of holes 46 near the center of the backplate 102 at step 228, the hub 54 and blades 16 are preferably attached in a single step 230 of riveting the lugs 56 (deforming the lugs by impacting with high-frequency hammers) and riveting or bending the protruding ends 104 of the blades 16. An example of a method of attaching individual blades of a blower wheel assembly through holes in a backplate is provided in U.S. Pat. No. 3,262,637, entitled INDIVIDUAL BLADE MOUNTINGS IN A BLOWER WHEEL, which is incorporated in its entirety herein by reference. Alternatively, the lugs 56 of the hub 54 may be attached to the backplate 102 by staking.

Figure 9A:
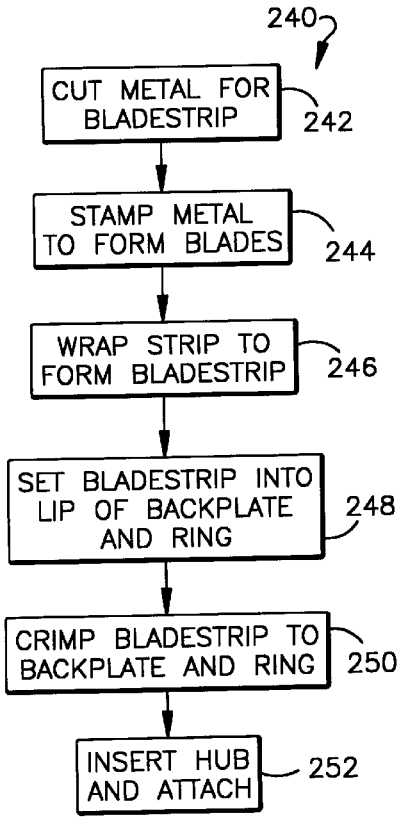
FIG. 9A is a flow chart showing the steps of an alternative method of assembling a blower wheel assembly according to the present invention.
Figure 9B:
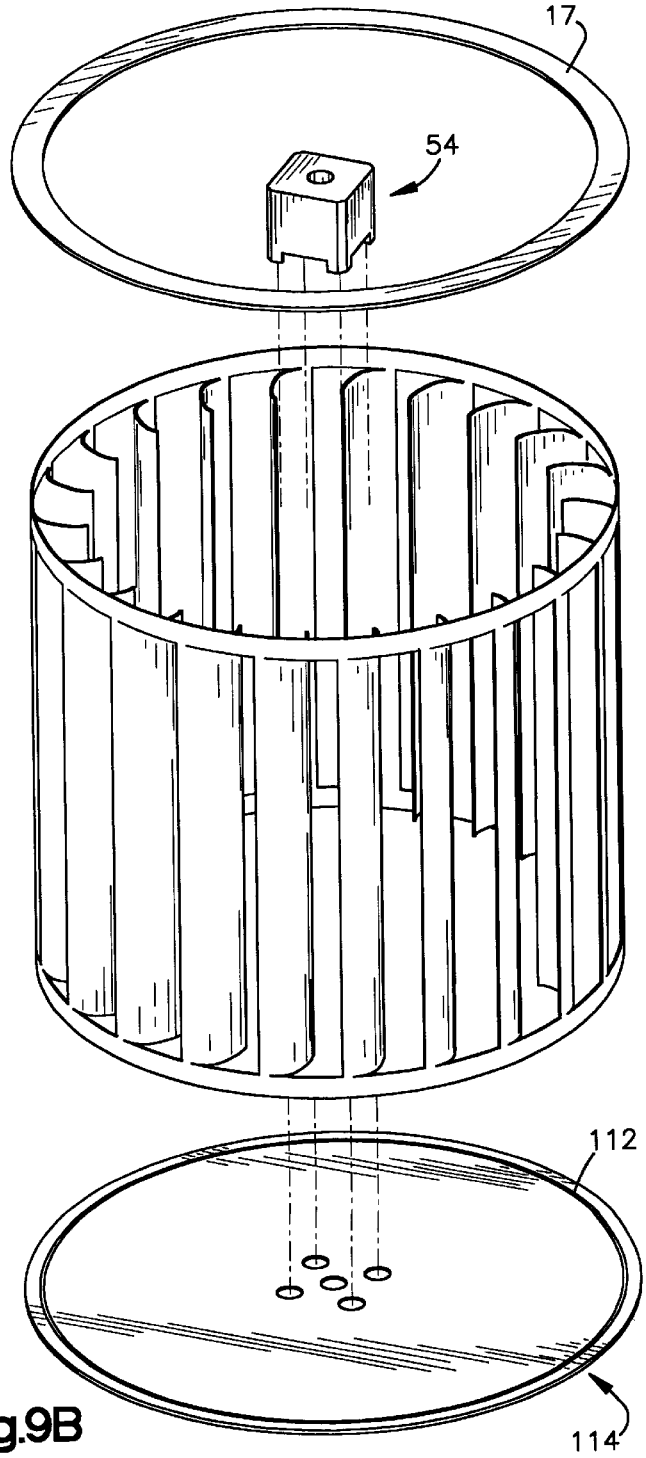
FIG. 9B is an exploded perspective view of the parts of the blower wheel assembly which are assembled by the method of FIG. 9A.

Another method 240 of manufacturing a blower wheel assembly according to the present invention is shown in FIGS. 9A and 9B. Initially a strip is cut from sheet metal at step 242, the strip of metal (not shown) is stamped at step 244 to form blades, and then the strip is wrapped at step 246 to form a cylindrical bladestrip 110. This method of forming a plurality of blades for a blower assembly as a single piece is demonstrated in U.S. Pat. No. 2,242,586, entitled METHOD OF MAKING BLOWERS, and in U.S. Pat. No. 3,711,914, entitled METHOD FOR ASSEMBLING CENTRIFUGAL BLOWERS, both of which are incorporated in their entireties herein by reference. The bladestrip 110 is then placed in an annular depression 112 near the perimeter of a backplate 114 and a ring 17 placed atop the bladestrip 114, at step 248. Thereafter, the bladestrip 110 is attached to the backplate 114 and the ring 17 by crimping at step 250. An example of a crimped bladestrip is shown in FIG. 2C. After the bladestrip 110 is attached to the backplate 114, the lugs 56 of the hub 54 are placed in the array of holes 46 in the backplate 114, and the hub 54 is attached to the backplate 114 by riveting, upsetting or otherwise deforming the lugs 56 at step 252.

Machining of steel hubs with lugs involves use of relatively expensive machines which require large capital outlays, and may be time-consuming when compared to other methods.

Figure 4A:
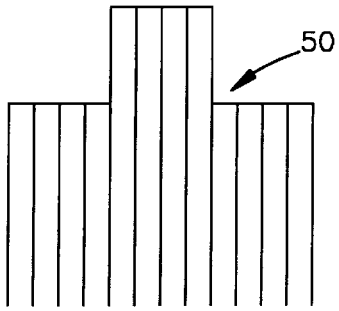
FIG. 4A is a side view showing the metal grains in the vicinity of a protrusion formed by machining.
Figure 4B:
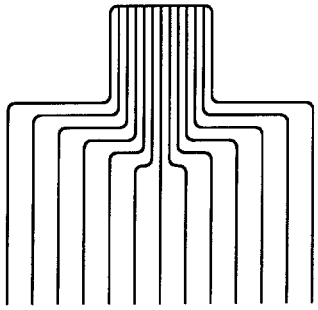
FIG. 4B is a side view showing the metal grains in the vicinity of a protrusion formed by cold heading.

Further, it has been noted that manufacturing steel hubs with lugs by machining possibly introduces structural weaknesses in the vicinity of the lugs. As illustrated in FIG. 4A, machining involves removing material, leaving the metal grains straight, breaking the grain flow and thereby creating a weakness at a junction 50 where a lug would be joined to the rest of the hub. This is in contrast to the continuous metal grains in a hub where the lugs are cold-headed, such as shown in FIG. 4B. With continuous metal grains following the outline of the hub the cold-headed hub is considered to have greater strength than a machined hub.

Nonetheless, machining offers advantages as well. Machining offers the advantage over cold heading of lower additional cost per part produced; even taking into account the large capital outlays required, machining may have lower cost per unit over the long term. In addition, lugs produced by machining do not share the below-described disadvantage of porosity and resulting weakness that occurs in lugs made by powdered metal processes.

Further, though lugs produced by machining have a theoretical potential to be weaker than lugs made by cold heading, hubs with lugs produced by machining have been found to have adequate strength in actual practice.

Figure 10D:
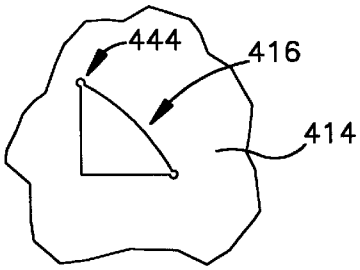
FIG. 10D is a plan view of a hub mounting hole of the blower wheel assembly of FIG. 10A, showing details of the stress relief portions of the hole.
Figure 10C:
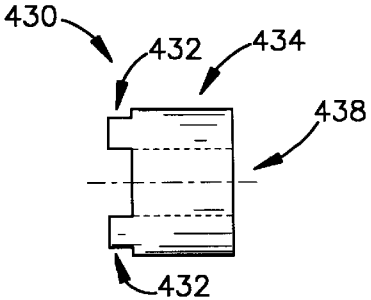
FIGS. 10B and 10C are bottom and side views, respectively, of a hub for use in the blower wheel assembly of FIG. 10A.
Figure 10B:
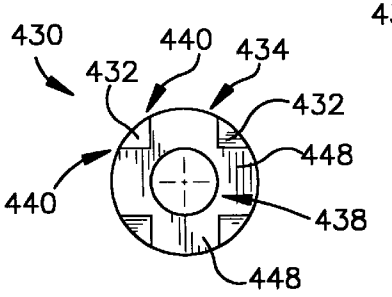
Figure 10E:
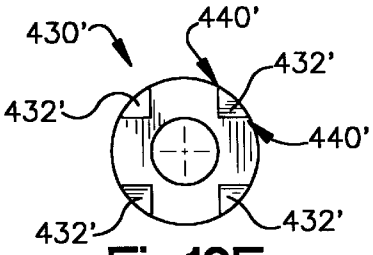
FIG. 10E is a bottom view of an alternate embodiment hub of the present invention.
Figure 10A:
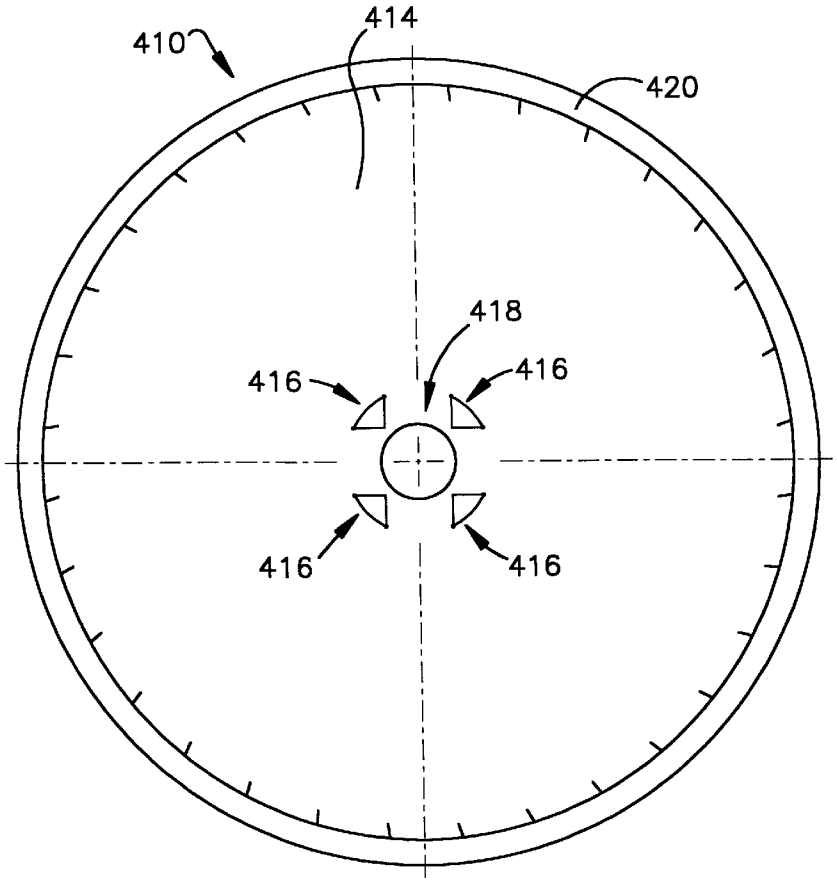
FIG. 10A is a plan view of an alternate embodiment blower wheel assembly of the present invention.

Referring now to FIG. 10A, an alternate embodiment blower wheel assembly 410 is shown. The blower wheel assembly 410 has many features in common with the blower wheel assemblies described above, details of which are omitted for the sake of brevity.

The assembly 410 includes a backplate 414 having an array of hub mounting holes 416, and a central hole 418. Blades or a bladestrip 420 are mounted onto and are connected to the backplate 414 along the perimeter of the backplate 414.

A hub 430 (FIGS. 10B and 10C) is connected to the backplate 414 as part of the assembly 410. The hub 430 has lugs 432 protruding from a body 434, the lugs 432 being of a size and shape such that they are able to pass through the hub mounting holes 416. Preferably the lugs have a cross-section substantially similar to that of the hub mounting holes.

The body 434 has a shaft mounting hole 438 therein for receiving a shaft (not shown). A mechanism is included for coupling the shaft to the hub 430. An exemplary mechanism is the set screw mechanism described above.

The lugs 432 each have sharp corners 440. As shown best in FIG. 10D, the hub mounting holes have stress relief portions, such as stress relief holes 444, in their corners which correspond to the sharp corners 440 of the lugs 432. The stress relief holes 444 may be formed, for example, by drilling or punching.

The stress relief portions serve to avoid stress concentrations at those corresponding corners. The stress concentrations may cause cracking at the corners which may result in failure of the assembly.

The stress relief holes may be larger or smaller than as shown in FIG. 10D, and may be so small as to make them barely visible.

It will be appreciated that the stress relief portions may take many forms, such as circular or other-shaped holes, or other mechanisms that remove the sharp corners of the hub mounting holes and/or prevent contact between the hub mounting holes and the sharp corners of the lugs.

It will further be appreciated that the hub body may have a shape other than a circular cross section, for example having a square cross section. The cross-sectional shape of the hub body may affect the shape of the resulting lugs.

The lugs for the hub shown in FIGS. 10B and 10C may be formed by a machining process. A cylindrical hub may be cut from steel wire having a circular cross section. Then, material may be milled or otherwise removed along flat faces 448 on the hub. This removal of material leaves the lugs 432 protruding from the hub body 434. Thereafter, the shaft mounting hole 438 may be bored in the hub 430.

Connection of the hub 430 to the backplate 414 is similar to the process described above with respect to another embodiment—the lugs 432 are inserted through the hub mounting holes 416, and then the ends of the lugs are deformed (flattened against the backplate 414) to secure the hub 430 to the backplate.

It will be appreciated that a greater of lesser number of lugs may be formed by, for example, changing the number of milling or material removing steps. For ease of manufacture, the removal of material steps preferably include sweeping across the hub, passing through the axis of the shaft mounting hole, with a swath wider than the diameter of the shaft mounting hole. Thus preferably the hub has an even number of lugs, although it will be appreciated that hubs with an odd number of lugs may also be formed with appropriate modifications to the above method.

Although the hub is described as being a steel hub with the lugs formed by machining, it will be appreciated that other materials and methods of manufacture may be used.

Figure 1:
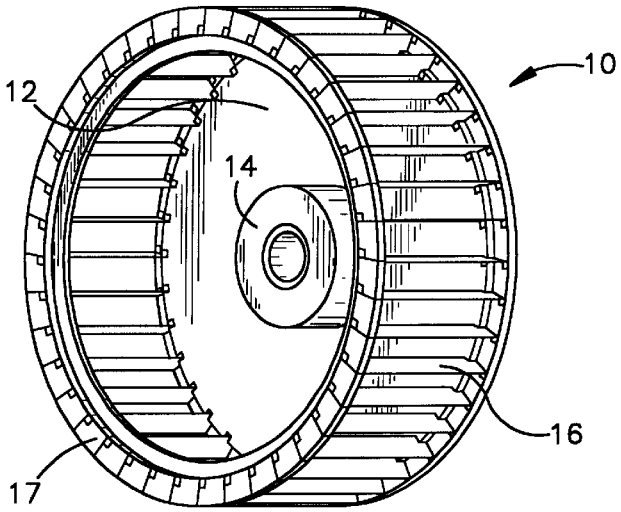
Fig.1 (PRIOR ART)
FIG. 1 is a perspective view of a prior art blower wheel assembly.

Referring to FIG. 1 OE, an alternate embodiment machined hub 430' is shown. The hub 430' has lugs 432' which have rounded corners 440'. The rounded corners 440' may reduce the amount of stress transmitted to the backplate in the vicinity of the corners of the hub mounting holes in the backplate. The rounded corners may be formed by machining or by other methods.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A blower wheel assembly comprising:

a backplate with an array of hub mounting holes therein;

a plurality of blades attached to the backplate; and a steel hub attached to the backplate, the steel hub having one or more lugs corresponding to the array of holes, the lugs being formed by a machining process.

2. The blower wheel assembly of claim 1, wherein the steel hub is attached to the backplate by the one or more lugs being deformed.

3. The blower wheel assembly of claim 1, wherein the steel hub has an even number of lugs.

4. The blower wheel assembly of claim 1, wherein the lugs each have at least one sharp corner.

5. The blower wheel assembly of claim 1, wherein the lugs have rounded corners.

6. The blower wheel assembly of claim 1, wherein each hub mounting hole has one or more stress relief portions.

7. The blower wheel assembly of claim 6, wherein the lugs each have one or more sharp corners, the sharp corners corresponding in location to the stress relief portions of respective hub mounting holes.

8. The blower wheel assembly of claim 6, wherein the stress relief portions include a radial slit at one or more corners of each hub mounting hole.

9. A method of manufacturing a blower wheel assembly comprising:

forming a steel hub having one or more machined lugs; and attaching the steel hub to a backplate which has an array of hub mounting holes corresponding to the one or more lugs, the attaching including:

inserting the lugs in the hub mounting holes; and deforming the lugs to lock the hub in place.

10. The method of claim 9, wherein the forming of the steel hub includes cutting a length of steel wire, and machining the length of wire to form the one or more lugs.

11. The method of claim 10, wherein the forming further includes rounding corners of the lugs.

12. The method of claim 10, wherein the machining includes removing material by sweeping across the hub, passing through an axis of the hub, thereby forming an even number of lugs.

13. The method of claim 12, wherein the removing material includes removing material such that the lugs are symmetrically formed on the hub.

14. The method of claim 9, wherein the inserting the lugs includes inserting the lugs such that sharp corners of the lugs are adjacent stress relief portions of respective hub mounting holes.

15. The method of claim 9, wherein the forming of the steel hub further comprises boring a hole in the hub, drilling a set screw hole through the hub, and tapping the set screw hole.

16. The method of claim 9, further comprising attaching a plurality of blades to the backplate.

17. A blower wheel assembly comprising:

a backplate with an array of hub mounting holes therein, each hub mounting hole having a stress relief portion;

a plurality of blades attached to the backplate; and a hub attached to the backplate, the hub having one or more lugs corresponding to the array of holes.

18. The blower wheel assembly of claim 17, wherein the lugs each have at least one sharp corner, the at least one sharp corner corresponding in location to the stress relief portion of the respective hub mounting hole.

19. The blower wheel assembly of claim 17, wherein the stress relief portion includes a radial slit at one or more corners of each hub mounting hole.

* * * * *

UNITED STATES PATENT AND TRADEMARK OFFICE

CERTIFICATE OF CORRECTION

PATENT NO.: 6,179,566

DATED: January 30, 2001

INVENTOR(S): Joseph H. Andulics
Gregory R. Nagy

It is certified that error appears in the above-identified patent and that said Letters Patent is hereby corrected as shown below:

Column 8, line 24: Please replace "FIG. 1 OE" with --FIG. 10E--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*